United States Patent [19]

Jensen

[11] Patent Number: 4,537,317

[45] Date of Patent: Aug. 27, 1985

[54] HEAVY DUTY TRAVEL CRANE

[75] Inventor: Lyle B. Jensen, Cedar Rapids, Iowa

[73] Assignee: FMC Corporation, Chicago, Ill.

[21] Appl. No.: 603,010

[22] Filed: Apr. 23, 1984

[51] Int. Cl.[3] ..... B66C 23/72

[52] U.S. Cl. ..... 212/189; 212/195

[58] Field of Search ..... 212/182, 189, 195–198, 212/239, 262

[56] References Cited

U.S. PATENT DOCUMENTS

| | | | |
|---|---|---|---|
| 2,452,632 | 11/1948 | Cameron | 37/116 |
| 3,836,010 | 9/1974 | Lampson | 212/49 |
| 3,842,984 | 10/1974 | Brown et al. | 212/49 |
| 3,868,022 | 2/1975 | Greenlay et al. | 212/8 R |
| 3,930,583 | 1/1976 | Jouffray | 212/49 |
| 3,955,684 | 5/1976 | Novotny | 212/197 |
| 4,170,309 | 10/1979 | Lampson | 212/48 |
| 4,196,816 | 4/1980 | Dvorsky et al. | 212/239 |
| 4,243,148 | 1/1981 | Lampson | 212/196 |
| 4,258,852 | 3/1981 | Juergens | 212/178 |

FOREIGN PATENT DOCUMENTS

| | | | |
|---|---|---|---|
| 2029795 | 3/1980 | United Kingdom | 212/195 |

OTHER PUBLICATIONS

An American Hoist & Derrick Co., Super Sky Horse, 1100 Series Brochure.

Neil F. Lampson, Inc., Lampson Transi-Lift Brochure.

Article entitled Development, Testing & Operation of World's Highest Capacity, Mobile Lift Crane by George D. Morse.

*Primary Examiner*—Trygve M. Blix

*Assistant Examiner*—Stephen P. Avila

*Attorney, Agent, or Firm*—A. J. Moore; H. M. Stanley; R. B. Megley

[57] ABSTRACT

A heavy duty travel crane is disclosed having two power driven mobile units each having an upper works pivotally supported by the lower works and interconnected by a spreader link. A boom and gantry are supported on one mobile unit and a plurality of winches and operator controls for both units are carried by the other unit with a counterweight supported on the spreader link immediately adjacent thereto. The winches are connected to hoists trained over the boom and gantry for supporting a load, and the counterweight is attached to the upper end of the gantry with the adjacent mobile power unit acting as an auxiliary counterweight if the load is of sufficient weight to lift the counterweight off the spreader link.

7 Claims, 5 Drawing Figures

HEAVY DUTY TRAVEL CRANE

BACKGROUND OF THE INVENTION

Field of the Invention

The present invention relates to heavy duty travel cranes and more particularly relates to such a crane with a counterweight between two powered mobile units.

Assignee's U.S. Pat. No. 4,196,816 which issued to Dvorsky et al on Apr. 8, 1980 is pertinent to the specific components of one of the mobile power driven units used in the crane.

SUMMARY OF THE INVENTION

The heavy duty travel crane of the present invention includes a pair of powered mobile units having upper works pivotally mounted on lower works and interconnected by a spreader link. The crane features a boom and a gantry pivotally supported on the upper works of one of the mobile units with the counterweight normally supported by the spreader link immediately adjacent the upper works of the other or main unit. The counterweight is operatively connected to the upper end of the gantry which is maintained at a predetermined angle during operation of the crane by a boom stop, and by a live mast and gantry hoist. Placement of the counterweight between the two units has the advantage of distributing the substantial weight of the counterweight between the two mobile units when traveling without a load. Also, placement of the counterweight between the two mobile units has the advantage of making the main mobile unit, which is disposed rearwardly of the boom, act as an auxiliary counterweight which is effective only if an extra heavy load tends to lift the counterweight off the spreader link.

DESCRIPTION OF THE PREFERRED EMBODIMENT

Figure 1:
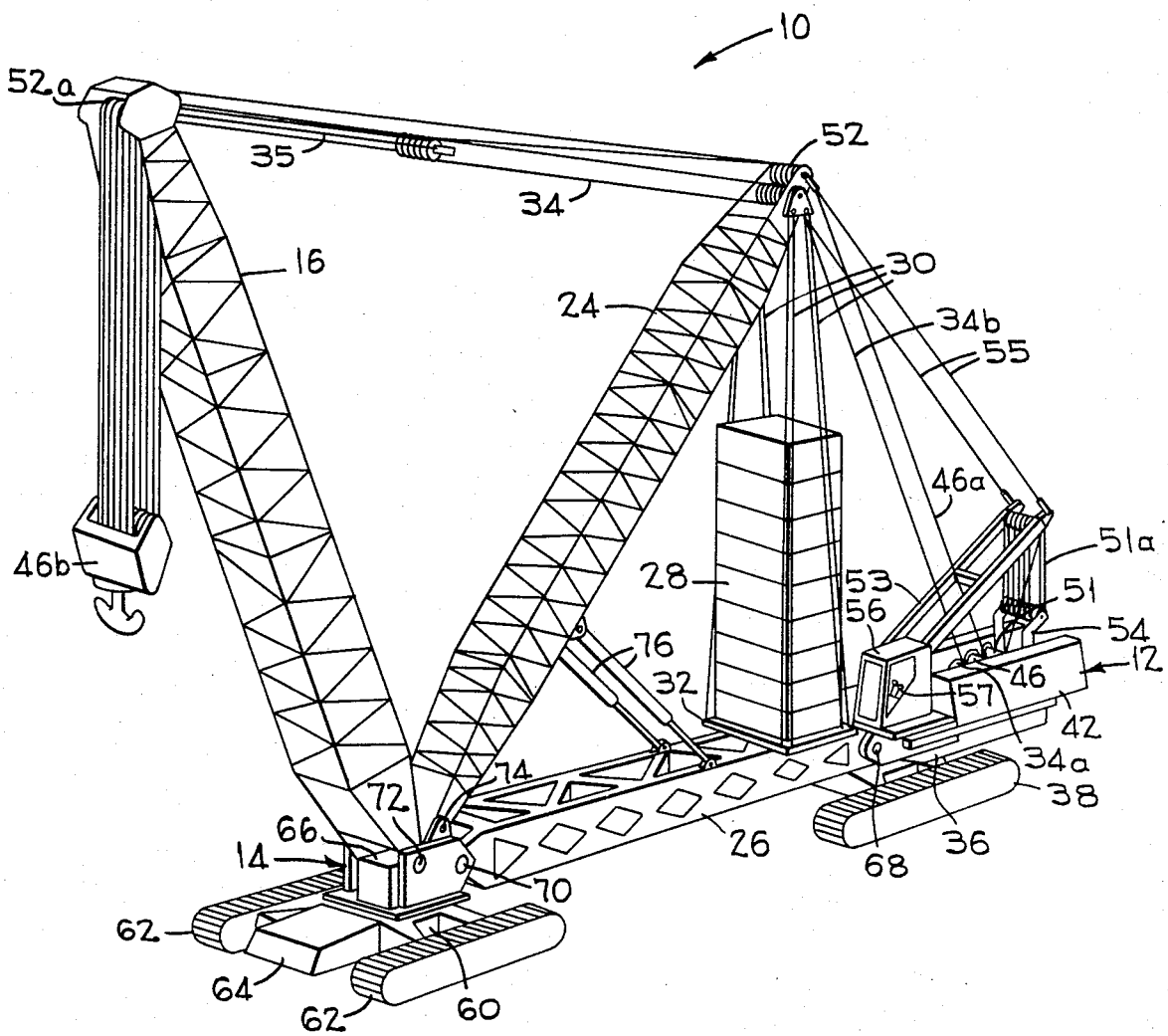
FIG. 1 is a diagrammatic perspective of the heavy duty crane of the present invention.

The heavy duty crane (FIGS. 1 and 2) of the present invention is designed to use existing components of other cranes and to combine them in a manner which will provide a relatively inexpensive crane capable of transporting heavy loads to different locations and using one of the mobile units as an auxiliary counterweight in the event an excessively large load tends to overbalance the crane.

In general, the heavy duty crane 10 comprises a power driven main mobile unit 12, and a power driven second mobile unit or transporter 14 that carries a boom 16 and a gantry 24. The mobile unit 12 and transporter 14 are spaced from each other by a spreader link 26 which also supports a multi-piece counterweight 28 that is attached to the upper end of the gantry by pendants 30 and includes a platform 32 resting on the spreader link. The upper ends of the boom and gantry are interconnected by boom hoist reaving 34 and pendants 35 for controlling the angular position of the boom 16 relative to the gantry 24.

More particularly, the main mobile unit 12 comprises a lower works 36 which is supported by tracks 38. The lower works supports an upper works 42 for rotation about a vertical axis. The upper works 42 includes a power unit or engine (not shown) for powering components on the main mobile unit 12 which includes at least a boom hoist line winch **34*a* (FIG. 2), a load line winch 46, and a live mast and gantry winch 51. A load line 46*a* is trained over sheaves 52 on the gantry 24 and a sheave 52*a* on the boom 16 and includes multiple strands which are connected to a hook 46*b* for raising or lowering a load L. A boom hoist line 34*b* is included in the hoist reeving 34 and is trained around the winch 34*a*. The live mast and gantry winch 51 is connected to a gantry hoist 51*a* that is connected between a live mast 53 and a bale assembly 54. The live mast 53 is connected to the upper end of the gantry 24 by a pair of pendants 55. An operator's cab 56 is included in the upper works 42 and is provided with control means 57 (FIG. 1) for operating the components of the main mobile unit 12 as well as the powered components of the transporter 14**.

The specific components of the main mobile unit 12 are of conventional design and may be identical (except for the controls) as those disclosed in the aforementioned Dvorsky et al U.S. Pat. No. 4,196,816 which is incorporated by reference herein.

The transporter 14 comprises a lower works 60 supported by tracks 62 that are driven by a power unit or engine 64. The lower works 60 supports an upper works 66 for rotation about a vertical axis by power from the engine 64 and under the control of an operator in the cab 56 of the main mobile unit 12. The transporter's lower works 60 may be the same as the lower works 36 of the main mobile unit 12 except that the lower works 60 of the transporter 14 has its engine mounted thereon whereas the engine (not shown) of the main mobile unit 12 is in the upper works 42. In this way the cost of the heavy duty crane is minimized. However, the transporter's lower works may be of heavier design than that of the main unit if it is contemplated that very heavy loads will be carried.

The spreader link 26 is pivoted to the upper works 42 of the main mobile unit 12, and to the upper works 66 of the transporter 14 by horizontal pivot pins 68,70, respectively. Likewise, the boom 16 and gantry 24 are pivoted to the transporter's upper works 66 by horizontal pivot pins 72 and 74, respectively. A pair of gantry stops 76 are connected between the gantry 24 and the spreader link 26 to permit the gantry to pivot clockwise to a stop position with the counterweight 28 supported on the spreader link 26 and the pendants 30 loosely attached to the upper end of the gantry.

The gantry 24 is of conventional design and may be identical to the boom used in the above referred to Dvorsky et al U.S. Pat. No. 4,196,816. Likewise, the boom hoist reeving 34, and the load line reeving **46*a* are of conventional design. It will also be understood that the boom 16** may be increased in length by adding additional boom sections in order to provide greater reach as is conventional in the crane art.

Figure 3:
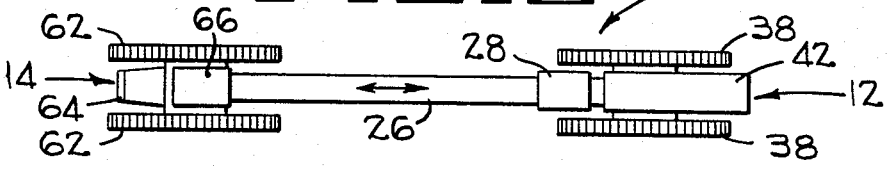
FIG. 3 is a diagrammatic operational view in plan, with the upper structure removed, to illustrate the mobile units positioned to move the crane longitudinally of the spreader link.
Figure 4:
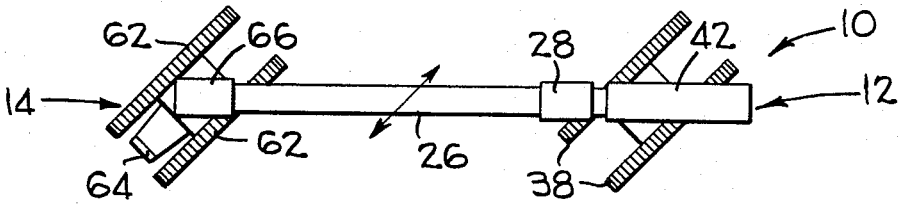
FIG. 4 is an operational view similar to FIG. 3 but illustrating the mobile units in position to drive the crane diagonally of the longitudinal axis of the spreader unit.
Figure 5:
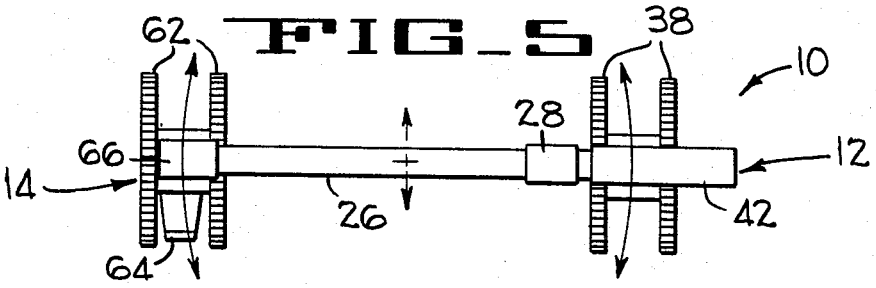
FIG. 5 is an operational view similar to FIG. 3 but illustrating the mobile units in position to drive the crane transversely of the spreaker link; to drive one mobile unit in an arc about the vertical axis of the other unit, or to pivot the crane about a vertical axis midway between the mobile units.

In operation, an operator enters the cab 56 of the main mobile unit and starts the engine (not shown) in the upper works 42 and the engine 64 of the transporter 14. The engines provide power for rotating the lower works 36 and 60 relative to their associated upper works 42 and 66, and for driving the associated tracks 38 and 62 which steer the heavy duty crane and move it to different locations. The engine in the main mobile unit 10 also provides power to the winches 34*a*,46 and 51. The operator then actuates controls 57 to drive the crane 10 in either direction parallel to the longitudinal axis of the spreader link 26 as illustrated in FIG. 3; in either direction and at any angle transverse of the longitudinal axis of the spreader link 26 as indicated in FIG. 4; in either direction perpendicular to the axis of the spreader link as indicated in FIG. 5; and drive either mobile power unit 12 or 14 in either direction about the vertical pivot axis of the other unit, or drive the units 12 or 14 in opposite directions to pivot the crane 10 about the mid-point of the spreader link 26. Thus, the operator has considerable control over the direction of travel of the crane 10.

Figure 2:
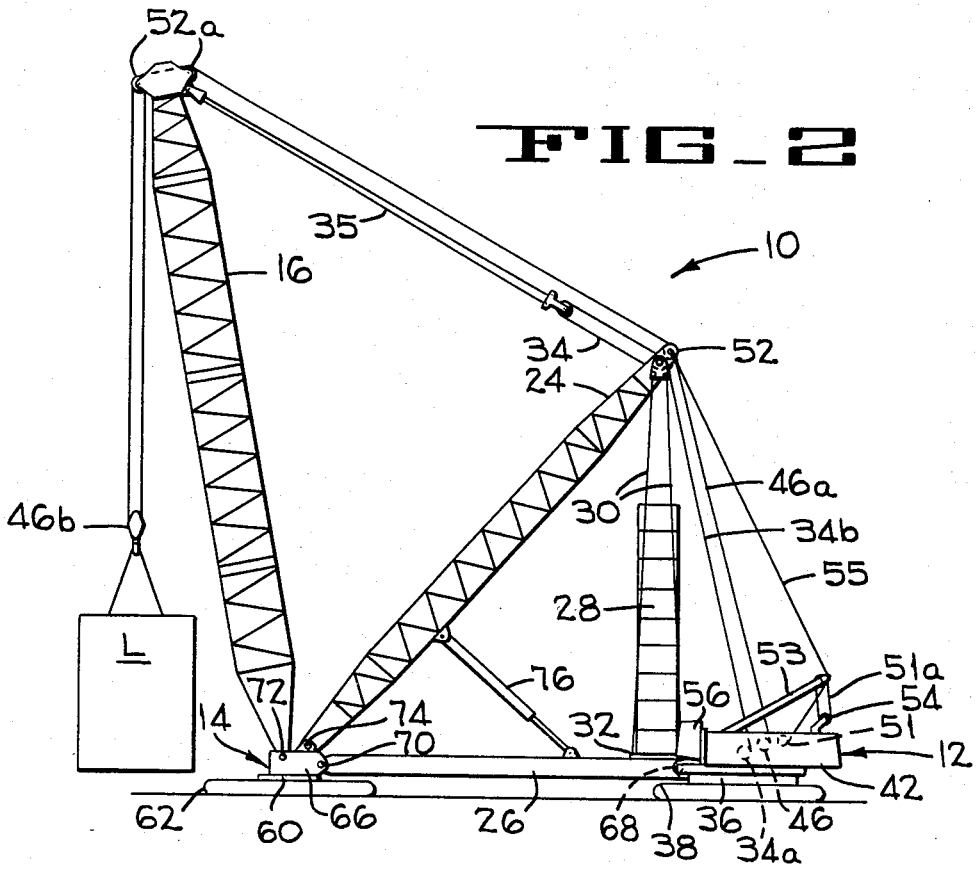
FIG. 2 is a diagrammatic side elevation of the crane of FIG. 1.

When the crane 10 is driven into position to pick up the load L, the transporter 14 is moved adjacent the load L with the longitudinal axis of the spreader link 26 passing through the center of gravity of the load. If necessary, the operator may then actuate the boom hoist winch 34*a* to pay out line thereby pivoting the boom 16 forward counterclockwise (FIG. 2) to extend the forward reach of the boom. The load line winch 46 may then be actuated to pay out the load line 46*a* to lower the hook 46*b* permitting the load L to be attached thereto. The operator then drives the load line winch 46 in the load lifting direction thereby lifting the load to transport position as indicated in FIG. 2. When driving the crane with the load L attached thereto, it is preferable that the lower surface of the load be close to the ground.

The lifting force applied by the load line 46*a* will be applied to the top of the boom 16, and then to the top of the gantry 24 by the pendants 35 and boom hoist reeving 34. This force will be counteracted by the counterweight 28 acting through pendants 30. The forces acting on the counterweight 20 tend to lift the counterweight off the spreader link 26, but the predetermined counterweight load is preferably sufficient to maintain the counterweight and platform 32 in engagement with the spreader link at the illustrated point immediately adjacent the main power unit 12 as best shown in FIG. 1. If, however, the counterclockwise force applied by the load L is greater than the clockwise force applied to the counterweight, the counterweight 28 may be lifted a short distance off the spreader link 26. The weight of the main mobile unit 12 will then act as an auxiliary counterweight through its operative attachment to the top of the gantry by the lines 34*b*,46*a* and pendants 55. Also, the pivotal connection between the upper works 42 and the spreader link 26 aids in assuring that the main power unit 12 will act as an auxiliary counterweight in the event the crane is overloaded.

After the load L has been lifted as indicated in FIG. 2, the operator selectively actuates steering and driving controls in the main unit 12 for pivoting one or both of the lower works relative to the upper works and/or driving the tracks 38 and/or 62 in the desired direction. As mentioned previously, the heavy duty crane may be driven in many directions as illustrated in FIGS. 3–5.

From the foregoing description it is apparent that the heavy duty crane of the present invention comprises a pair of mobile units having powered tracks on the lower works which support upper works for pivotable movement about vertical axes. The upper works are interconnected by a spreader link with a multi-section counterweight supported by the spreader link. A boom and gantry are pivotally supported by the upper works of one mobile unit, while the upper works of the other mobile unit includes operator controls for operating both units including winches which actuate several hoists trained over the gantry and boom for supporting a load. The counterweight is supported by the spreader link between the mobile units at a point immediately adjacent the winch supporting upper works and is attached to the upper end of the gantry to counterbalance the weight of the load. If the load is excessively heavy and overbalances the counterweight, the winch supporting power unit acts as an auxiliary counterweight.

Although the best mode contemplated for carrying out the present invention has been herein shown and described, it will be apparent that modification and variation may be made without departing from what is regarded to be the subject matter of the invention.

What is claimed is:

1. A heavy duty mobile crane comprising:

means defining a steerable power driven main mobile unit supported by only two ground engaging propelling members which members remain parallel to each other at all times;

means defining a steerable independently power driven second mobile unit supported by only two second ground engaging propelling members which remain parallel to each other at all times;

a spreader link pivotally connected to said main and second mobile units for separating said units from each other a distance of at least one and one-half times the length of said ground engaging propelling members of said main unit when said propelling members are parallel to said spreader link;

a boom pivotally mounted on and supported by said second mobile unit and having an outer end;

a gantry pivotally mounted on and supported by said second mobile unit and having an outer end;

load engaging means including a load line trained over the outer ends of said boom and said gantry and adapted to be operatively connected to a load for lifting the load off the ground;

a counterweight supported on said spreader link between said mobile unit at a location adjacent said main mobile unit and operatively connected to and directly below the outer end of said gantry for counterbalancing said load;

boom positioning and hoisting means including a boom hoist line operatively connected to the upper ends of said boom and gantry and to the main control unit; and control means for actuating said load lifting means for raising said load and for thereafter actuating said mobile units for carrying the load to a different location.

2. An apparatus according to claim 1 wherein said main mobile unit acts as an auxiliary counterweight to prevent overbalancing of the crane in the event an excessively heavy load lifts the counterweight off of said spreader link.

3. A heavy duty mobile crane comprising:

means defining a power driven main mobile unit including a lower works mounted on only two ground engaging track means which remain parallel to each other at all times and which support an upper works for pivotal movement about a vertical axis;

means defining an independent power driven second mobile unit including a second lower works mounted on only two ground engaging track means which remain parallel to each other at all times and which support an upper works for pivotal movement about a vertical axis;

a spreader link pivotally connected to said main and second mobile units for separating said units from each other a distance of at least one and one-half times the length of said grounding engaging track means of said main unit when said track means are parallel to said spreader link;

a boom pivotally mounted on the upper works of said second mobile unit and having an outer end;

a gantry pivotally mounted on the upper works of said mobile unit and having an outer end;

load lifting means including a load line trained over the outer ends of said boom and said gantry and adapted to be operatively connected to a load for lifting the load off the ground;

means defining a counterweight supported on said spreader link between said mobile units at a location adjacent said main mobile unit and operatively connected to the upper outer end of said gantry for counterbalancing said load;

boom positioning and hoisting means including a boom hoist line operatively connected to the upper ends of said boom and said gantry and to the upper works of said main mobile unit; and control means for actuating said load lifting means for raising said load and for thereafter actuating said power driven mobile units for carrying said load to a different location.

4. An apparatus according to claim 3 wherein supporting said counterweight on said spreader link distributes a portion of the weight of the counterweight onto said second mobile unit when the crane is moving to a different location prior to connecting said load lifting means to a load.

5. An apparatus according to claim 4 wherein said main mobile unit acts as an auxiliary counterweight to prevent overbalancing of the crane in the event an excessively heavy load lifts the counterweight off of said spreader link.

6. An apparatus according to claim 3 and additionally comprising a cab, and wherein said cab and said control means are mounted on the upper works of said main mobile unit and are operatively connected to powered components of both of said mobile units.

7. An apparatus according to claim 6 wherein said control means may be actuated to pivot said lower works of said main and second mobile units relative to said associated upper works to maintain said ground engaging track means of the mobile units parallel to each other through an arcuate range of at least 180°, said control means also including means for controlling the direction of movement of said ground engaging track means for driving the crane as a unit in the selected direction.

* * * * *